US007017768B2

(12) United States Patent
Iskierka

(10) Patent No.: US 7,017,768 B2
(45) Date of Patent: Mar. 28, 2006

(54) FLOATABLE BARRIER FOR USE WITH A BEVERAGE CONTAINER

(76) Inventor: Randy Jerome Iskierka, 100 River Edge Way, NE., Fridley, MN (US) 55432

( * ) Notice: Subject to any disclaimer, the term of this patent is extended or adjusted under 35 U.S.C. 154(b) by 179 days.

(21) Appl. No.: 10/152,428

(22) Filed: May 21, 2002

(65) Prior Publication Data

US 2003/0218016 A1 Nov. 27, 2003

(51) Int. Cl.
*B65D 88/34* (2006.01)

(52) U.S. Cl. ..... 220/216; 220/578; 220/215; 220/719; 220/731; 220/521; 215/387; 215/231; 222/564; 222/547; 116/207; 116/216; 283/56; 40/311

(58) Field of Classification Search ..... 220/521, 220/220, 369, 719, 706, 737, 602, 227, 215, 220/216, 219, 560, 580, 592.05, 592.16, 220/592.28, 578, 703, 704, 716, 731, 734, 220/739; 215/231, 387, 388, 393; 405/219; 114/267; 441/67, 136, 45, 108; 40/311, 360; 4/292; 5/707, 929; 349/20; 248/346.11; 211/71.01; 210/464; 116/207, 216; D7/624.1; 222/564, 222/249; D9/454; 283/56
See application file for complete search history.

(56) References Cited

U.S. PATENT DOCUMENTS

| | | | | | |
|---|---|---|---|---|---|
| 203,180 | A | | 4/1878 | Miller | |
| 1,089,652 | A | * | 3/1914 | Lisbae | 5/710 |
| 1,990,918 | A | | 2/1935 | Ramsden | |
| 2,488,542 | A | * | 11/1949 | Houghtaling | 114/264 |
| 2,531,562 | A | * | 11/1950 | Eve | 47/80 |
| 2,556,195 | A | | 6/1951 | Kors | |
| 3,049,261 | A | * | 8/1962 | Wade et al. | 220/216 |
| 3,199,469 | A | * | 8/1965 | Sullivan | 108/53.3 |
| 3,251,639 | A | * | 5/1966 | Silowash, Sr. | 312/351 |
| 3,256,977 | A | | 6/1966 | Pettersen | |
| 3,266,662 | A | | 8/1966 | Craig | |
| 3,357,590 | A | * | 12/1967 | Safford | 220/23.83 |
| 3,360,161 | A | * | 12/1967 | Smith | 220/719 |
| 3,413,743 | A | | 12/1968 | Goodhue | |
| 3,549,044 | A | * | 12/1970 | Lerner | 220/719 |
| 3,717,922 | A | | 2/1973 | Witkowski | |
| 3,762,591 | A | * | 10/1973 | Gray | 215/393 |
| 3,800,911 | A | * | 4/1974 | Reynolds et al. | 182/18 |
| 3,868,043 | A | | 2/1975 | Freemyer | |
| 3,974,758 | A | | 8/1976 | Stone, Jr. | |
| 4,028,750 | A | * | 6/1977 | Gustafsson | 4/498 |

(Continued)

FOREIGN PATENT DOCUMENTS

| | | | |
|---|---|---|---|
| CA | 453241 | * | 12/1948 |
| GB | 2123273 | A | 2/1984 |
| JP | 11000253 | A * | 1/1999 |

*Primary Examiner*—Lee Young
*Assistant Examiner*—James Smalley
(74) *Attorney, Agent, or Firm*—Michael A. Mochinski

(57) ABSTRACT

A floatable barrier suitably adapted for use with a beverage container having a circular base and a cylindrical wall extending vertically therefrom. The floatable barrier comprising top and bottom planar surfaces for displaying advertising material thereon and for floatingly engaging a substantial portion of a comestible liquid contained in the beverage container, respectively; an outer wall integrally connecting the top and bottom planar surfaces along the periphery thereof principally serving as means to space apart and maintain a parallel relationship of the surfaces to form an inner chamber possessing thermal retaining and buoyancy characteristics; and a plurality of apertures collectively located along the periphery of and extending from the top planar surface to the bottom planar surface, through the inner chamber, to assist in promoting the condition of laminar flow over the floatable barrier as the beverage container is being filled with the comestible liquid.

21 Claims, 7 Drawing Sheets

U.S. PATENT DOCUMENTS 4,198,920 A * 4/1980 Russell ..... 116/202
4,625,883 A 12/1986 Burke et al.
4,723,674 A 2/1988 Nunes
4,733,792 A 3/1988 Wasserman et al.
4,749,606 A * 6/1988 Moore ..... 428/166
4,789,073 A 12/1988 Fine
4,833,823 A * 5/1989 Edwards, III ..... 47/39
4,900,637 A * 2/1990 Darovec ..... 428/577
4,907,719 A 3/1990 Spotholz et al.
4,910,811 A * 3/1990 Izzi, Sr. ..... 4/292
4,938,377 A 7/1990 Jarvis
D315,474 S 3/1991 Turner
5,018,695 A * 5/1991 Bishop ..... 248/346.11
5,148,951 A * 9/1992 Moure et al. ..... 222/386
5,223,958 A * 6/1993 Berry ..... 349/20
5,339,981 A 8/1994 Kral
D353,298 S * 12/1994 Hartpence et al. ..... D7/400
5,540,350 A * 7/1996 Lansky ..... 220/380
5,720,555 A * 2/1998 Elele ..... 374/150
5,727,712 A * 3/1998 Costello ..... 220/703
5,802,956 A * 9/1998 Robertson et al. ..... 99/276
5,816,332 A * 10/1998 Alhamad ..... 169/45
5,827,555 A 10/1998 Thorne et al.
6,029,845 A * 2/2000 Mueller ..... 220/560
6,056,206 A * 5/2000 Whiton ..... 239/33
6,102,352 A * 8/2000 Kvalvog ..... 248/346.11
6,145,463 A * 11/2000 Zeilinger ..... 114/267

* cited by examiner

FLOATABLE BARRIER FOR USE WITH A BEVERAGE CONTAINER

FIELD OF THE INVENTION

The present invention relates in general to a floatable barrier made adaptable for use with a beverage container. More specifically, the present invention provides means to retain liquids in a beverage container and prevent spillage therefrom during transport and handling thereof as well as serving as a device to display advertising material thereon to promote an event or the sale of a good or service.

BACKGROUND OF THE INVENTION

Traditionally, a product and/or the accompanying packaging material bearing the trademark of the manufacture suffices as the most common or typical means to market a product in commerce. Obviously, this form of advertising is very limited insofar that the commercial impression on the consumer is short-lived due its basic inadequacy of being a disposable item. Thus, once used, each is loss of means for effective advertising. Nonetheless, numerous devices have evolved over the years to assist in the effective marketing of products besides that of the packaging material or the product in and of itself. One would be hard-pressed not to find such devices in today's advertising-savvy economy; one simply cannot avoid such means of advertising. Those worth mentioning and most relevant to the present invention generally comprise of some sort of transportable carrier having sufficient area to bear a company's trademark or slogan to draw further attention to a particular product or event worth promotion. In typical instances of its usage as an advertising medium, the carrier may be either used in further promotion of the product it accompanies or used to promote another product, quite different from the one it attaches to. Such devices well known in the art for use with a beverage container and serving as a medium for advertising include a coaster of the type generally placed on a table's surface, below a beverage container, an all-encompassing insulating barrier fitted about and around the beverage container, commonly known in the art as a "huggy," and a stir stick placed within the beverage container, to name a few. As in most cases, particularly with those as previously mentioned, the advertising medium may comprise of added functionality besides that of promoting a product or event. For example, the coaster generally serves as a protective barrier between the beverage bottom and table surface to inhibit scratching thereof or spillage thereon, while the huggy assists in retaining the thermal capacity of the liquid contained within the beverage container. Although each of these devices more or less possesses dual capabilities, and in some cases more, there are apparent limitations or draw backs associated with each device, particularly relating to the means for effective promotion of a product or event. The most apparent limitation is associated with the user's handing and use of the product insofar to interfere with the device's ability to continually serve as an effective advertising medium. For example, the coaster as well as the huggy will generally comprise of an adequate surface for displaying advertising material thereon, but later may be obstructed by the user's placement or usage of the product (i.e., placement of hands about the huggy and beverage container sitting atop the coaster effectively block-out the advertisement).

In accordance with the present invention, applicant has appreciably devised a mechanism for repeated and continual means of promoting a product or event in anticipation of enhancing the overall commercial impression on the consumer, while at the same time providing a device having spill prevention and thermal retention capabilities, such device being easily fitted into and movable from an existing beverage container without undue modification thereof.

BRIEF SUMMARY OF THE INVENTION

In order to overcome the numerous drawbacks apparent in the prior art, a floatable barrier has been devised for use with a beverage container of predetermined size and shape.

It is thus an object of the present invention to provide a low cost, non-complicated device which may be reliably used with numerous types of beverage containers to retain liquids therein and prevent spillage therefrom during transport and handling thereof It is another object of the present invention to provide such a floatable barrier which affords versatility in terms of functioning as means to display advertising material thereon for continuous promotion of a product or an event.

It is another object of the present invention to provide such a floatable barrier which possesses the capacity of being completely fitted into and removed from an existing beverage container without undue modification thereof.

It is another object of the present invention to provide such a floatable barrier having the capacity to mitigate heat loss of substances contained within the beverage container during use thereof.

It is another object of the present invention to provide such a floatable barrier to mitigate the opportunity for introducing foreign objects and the like into substances contained in the beverage container and provide easy means for retrieval of such objects in the event of inadvertent placement thereof into the beverage container.

It is yet another object of the present invention to provide such a floatable barrier which accomplishes the foregoing and other objects and advantages and which is economical, durable, and fully effective in performing its intended functions without undue retrofitting of the beverage container.

In accordance with the present invention, a floatable barrier has been devised for use with a beverage container being geometrically configured to accept and receive such device, the floatable barrier comprising in combination top and bottom planar surfaces for displaying advertising material thereon and for floatingly engaging a substantial portion of a comestible liquid contained in the beverage container, respectively, each planar surface further comprising a peripheral edge of which is maintained away from the cylindrical wall of the beverage container a predetermined distance to form an annular opening to permit the passage of the comestible liquid; the top and bottom planar surfaces being substantially spaced apart in a parallel arrangement and being integrally connected along the peripheral edge by an outer wall to form an inner chamber possessing thermal retaining and buoyancy characteristics; and a plurality of apertures substantially extending through the top and bottom planar surfaces, near the outer wall and along the peripheral edge, to ensure an opportunity for the continuous passing of the comestible liquid into and from the beverage container together with that of the annular opening, each aperture further comprising an inner wall to assist in promoting the condition of laminar flow over the top planar surface and to mitigate the occurrence of turbulence leading to undue volatilization of the comestible liquid as the beverage container is being filled to capacity.

Other objects, features, and advantages of the present invention will become apparent in the following detailed description of the preferred embodiments thereof when read in conjunction with the accompanying drawings in which like reference numerals depict the same parts in the various views.

BRIEF DESCRIPTION OF THE SEVERAL VIEWS OF THE DRAWINGS

A preferred embodiment of the present invention will now be described by way of example with reference to the accompanying drawings, in which.

DETAILED DESCRIPTION OF THE PREFERRED EMBODIMENT

While this invention is susceptible of being embodied in many different forms, the preferred embodiment of the invention is illustrated in the accompanying drawings and described in detail hereinafter with the understanding that the present disclosure is to be considered to exemplify the principles of the present invention and is not intended to limit the invention to the embodiments illustrated and presented herein. The present invention has particular utility as a device for use with a beverage container to display advertising material and mitigate inadvertent release of liquids from the beverage container during transport and handling thereof and retain the thermal capacity of substances contained therewithin.

Figure 1:
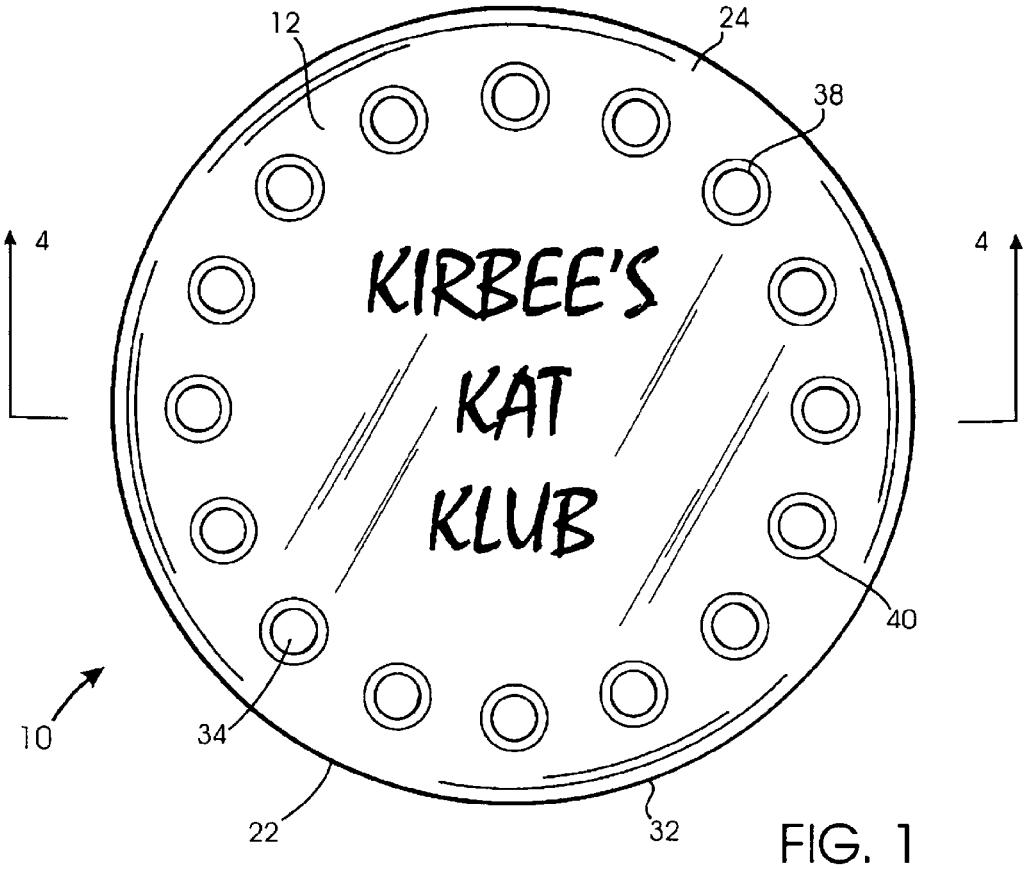
FIG. 1 is a top view of the preferred embodiment of the present invention.
Figure 2:
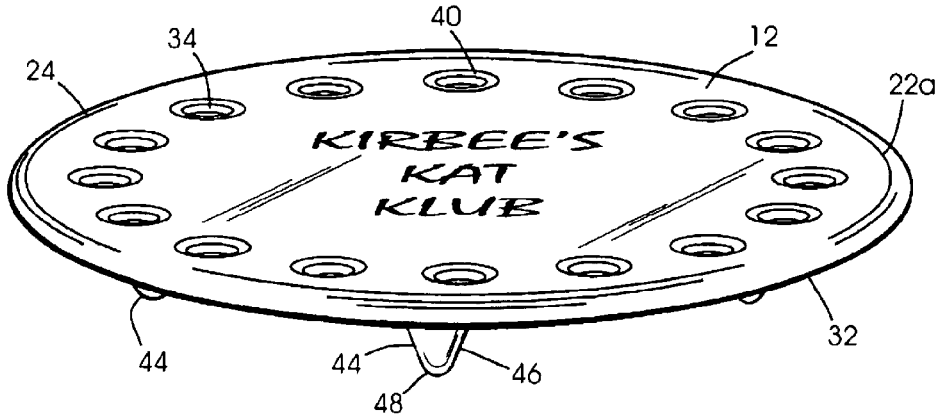
FIG. 2 is a side perspective view of the preferred embodiment of the present invention illustrating advertising material displayed on a top planar surface.
Figure 3:
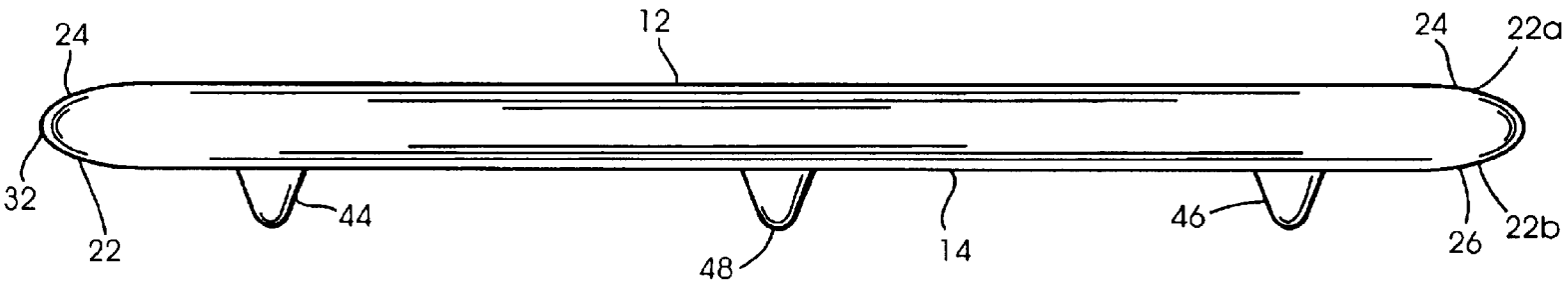
FIG. 3 is a side elevational view of the preferred embodiment of the present invention.
Figure 4:
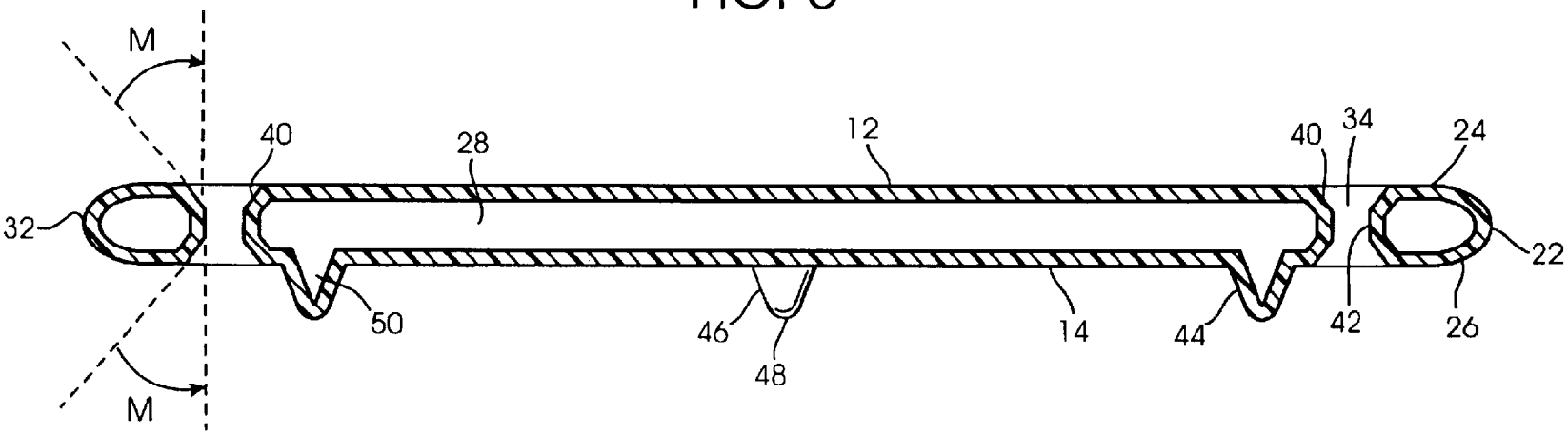
FIG. 4 is a side cross sectional view of the preferred embodiment of the present invention taken on line 4—4 of FIG. 1.

Referring to FIGS. 1 and 2, there is shown generally at 10 a floatable barrier having a top planar surface 12 suitably configured to display advertising material thereon and a bottom planar surface 14 adaptably configured to engage a substantial portion of a comestible liquid contained in a beverage container 16. It should be noted that the present invention is suitably adapted for use with a beverage container 16 having a geometric configuration comprising a circular base 18 and a cylindrical wall 20 extending vertically therefrom, substantially straight, most notably resembling a coffee mug of the type commonly known in the art. In the preferred embodiment, the top and bottom planar surfaces 12, 14 are configurably parallel and substantially symmetrical to one another in terms of shape and form and are held apart from one another a predetermined distance by an outer wall 22. As illustrated in FIG. 3, the outer wall comprises uppermost and lowermost ends 22*a*, 22*b* integrally connected to peripheral edges 24, 26 of the top and bottom surfaces, respectively, to the extent that the outer wall 22 is situated in between the top and bottom planar surfaces, resulting in a configuration which principally forms and defines an inner chamber 28 possessing buoyancy and thermal-retaining characteristics. Preferably, the top and bottom planar surfaces 12, 14 as well as the outer wall 22 are made from a hydrophobic, food-grade polymeric material. The polymeric material of choice must be capable of resisting heat and not degrade after sustained exposure to high temperatures and acidic/basic conditions. Moreover, the polymeric material should be readily impervious to the adsorption of odors or binding of aromas and posses a sufficiently smooth surface for ready cleanup after prolong and sustained use. Suitable types of materials considered most appropriate for this application may consist of polycarbonate, polyvinyl chloride, Teflon®, and Ultem®, to name a few of the types readily available and commonly known in the art. As depicted in FIGS. 3 and 4, the inner chamber 28 is configured to receive and house a gas possessing sufficient capabilities to insulate and further retain the thermal capacity of the comestible liquid contained in the beverage container 16. In typical applications, air or an equivalent gas having a low thermal conductivity would be most suitable and, therefore, preferred over a solid or liquid having similar thermal conducting properties. However, in the alternative, the inner chamber 28 may comprise simply of an air-entrained, light-weighted solid, such as Styrofoam,® to aid in gaining desirable insulating characteristics while retaining acceptable weight limits for continued buoyancy.

In an alternative embodiment, one of which enhances the display of advertising material in a controlled manner in terms of time, the top and bottom surfaces 12, 14 of the floatable barrier 10 may be fabricated from a translucent polypropylene material, with the inner chamber 28 containing thermotropic liquid crystals having temperature dependent characteristics. Preferably the liquids crystals would comprise the same color as the advertising print embedded on the top surface insofar to allow the advertising print to be non-visible at room temperature. Once a liquid of a higher or lower temperature is introduced into the beverage container and contacts the floatable barrier, the temperature sensitive crystals contained within the inner chamber 28 would favorably react to a different contrasting color, thereby promoting the exposure of advertising material adaptably affixed to the top surface of the floatable barrier. This configuration is particularly suitable for use where the floatable barrier 10 is placed into the beverage container 16 absent any liquid content, and the user later places a comestible liquid therein to correspondingly produce a vivid display of advertising material.

Figure 5:
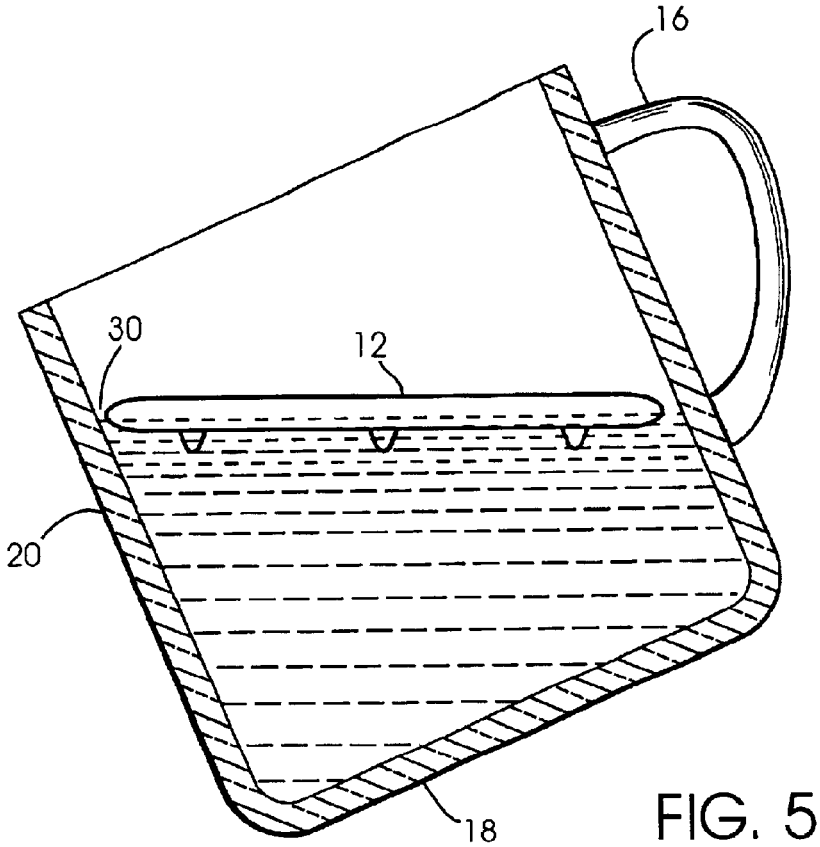
FIG. 5 is a side cross sectional view of the preferred embodiment of the present invention taken on line 5—5 of FIG. 6 illustrating a floatable barrier positioned in a beverage container.
Figure 6:
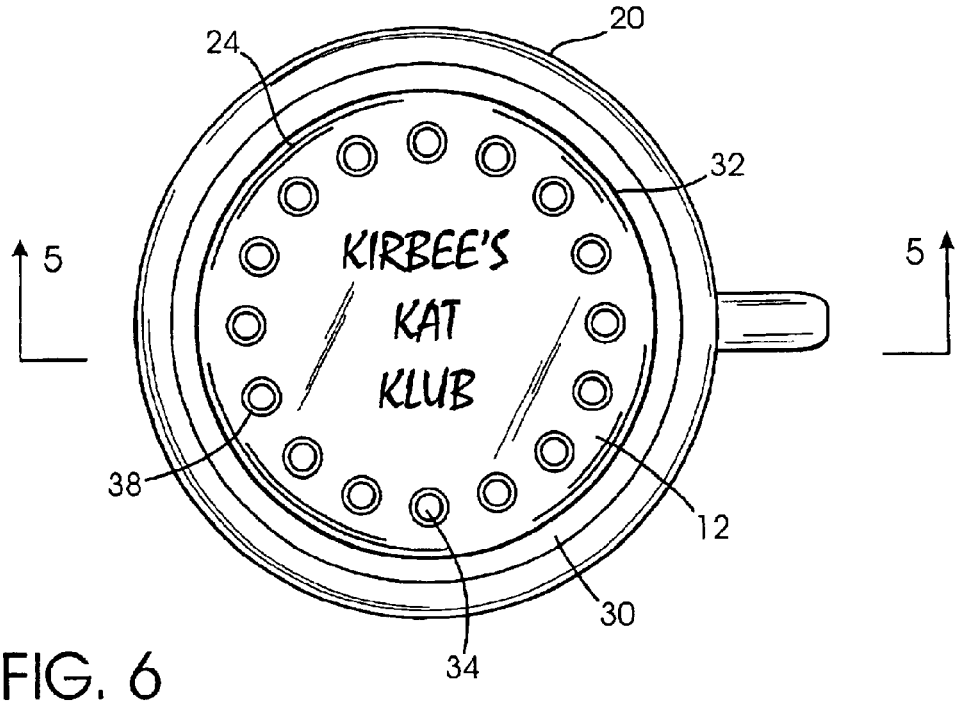
FIG. 6 is a top view of the preferred embodiment of the present invention illustrating a floatable barrier positioned in a beverage container.

As best illustrated in FIGS. 5 and 6, the outer wall 22 is preferably disposed in proximity to the cylindrical wall 20 of the beverage container, but away therefrom a predetermined distance to form an annular opening 30. This annular opening principally serves as means for continuous passing of the comestible liquid to and from the beverage container without necessitating removal of the floatable barrier 10 therefrom and to permit unhindered movement of the floatable barrier as it floatingly engages the beverage container's contents. The dimensioning of the annular opening 30 is principally established by the diameter of the floatable barrier relative to the diameter of the beverage container, preferably equating to approximately 90%, but less than 100% of the effective inner diameter of the beverage container. However, a distance of approximately ⅛" between the outer wall 22 and cylindrical wall 20 of the beverage container has been shown to serve as an effective passageway for liquids as the floatable barrier 10 transitions from a static state to one of a dynamic state, noticeably at the moment when the contents are drawn from the beverage container by the user. In some instances, to ensure continued, unhindered movement of the floatable barrier as it follows and conforms to the substance's level, most notably when the user tips the beverage container to consume the contents therefrom, the outer wall 22 may be rounded and comprise an apex 32 existing near the peripheral edges 24, 26 and extending furthermost beyond the diameter of the top and bottom planar surfaces 12, 14 a predetermined distance. As depicted in FIG. 3, the apex is substantially established at the midpoint between the uppermost and lowermost ends 22*a*, 22*b* of the outer wall 22 and will momentarily engage a portion of the cylindrical wall 20 of the beverage container as the beverage container 16 configurably tips to release substances therefrom. In a static state, one of which the beverage container is placed on a supporting surface or not in motion or being handled by the user, the apex 32 will generally establish itself to substantially coincide with the liquid level, as best illustrated in FIG. 5.

Figure 7:
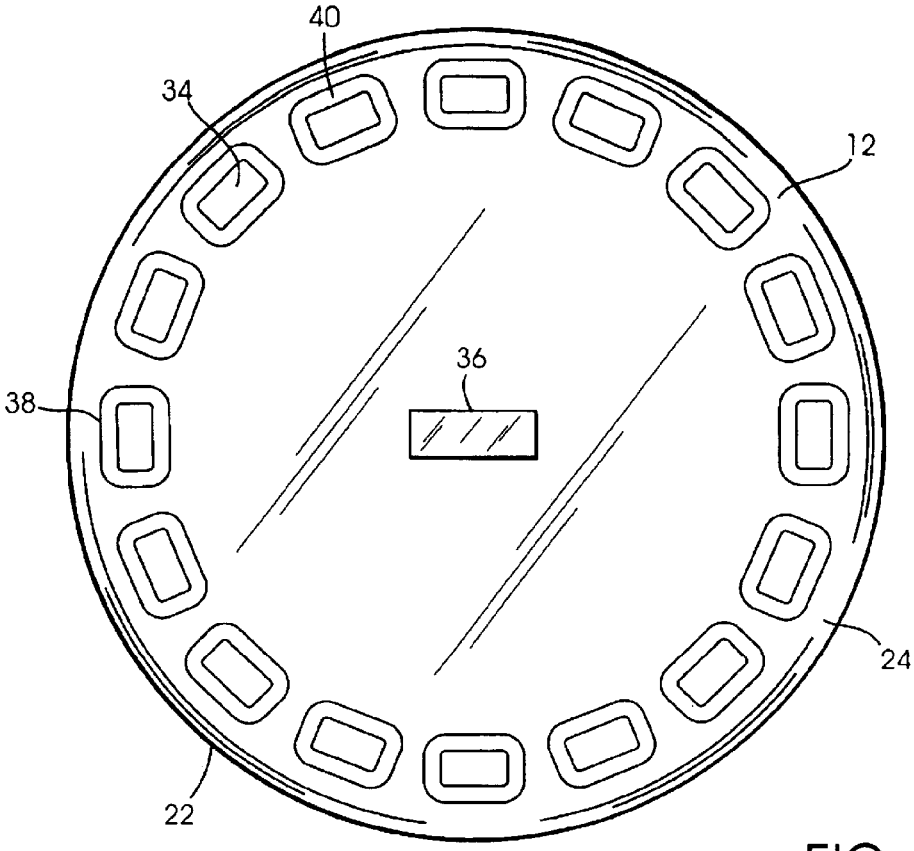
FIG. 7 is a top view of a second embodiment of the present invention illustrating a plurality of apertures extending therethrough and a handle assembly connected to a top planar surface.
Figure 8:
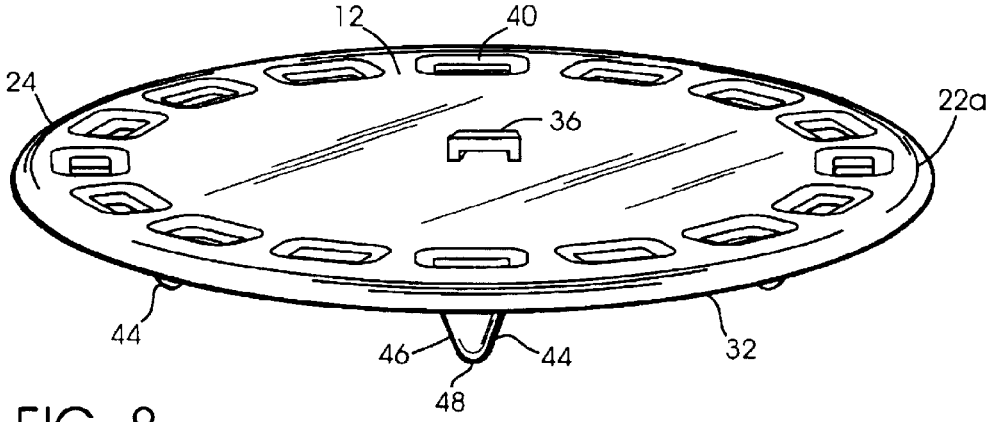
FIG. 8 is a side perspective view of second embodiment of the present invention illustrating the positioning of a plurality of protuberances extending downwardly from a bottom planar surface.
Figure 9:
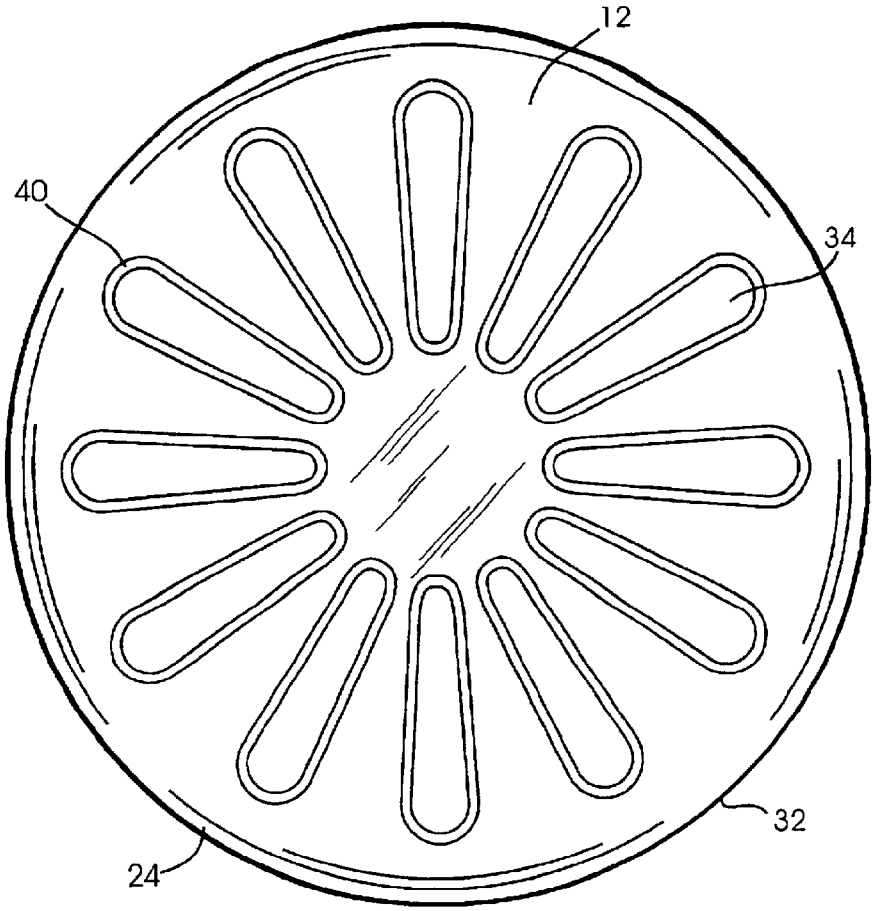
FIG. 9 is a top view of a third embodiment of the present invention illustrating the configuration of a plurality of apertures extending therethrough.
Figure 10:
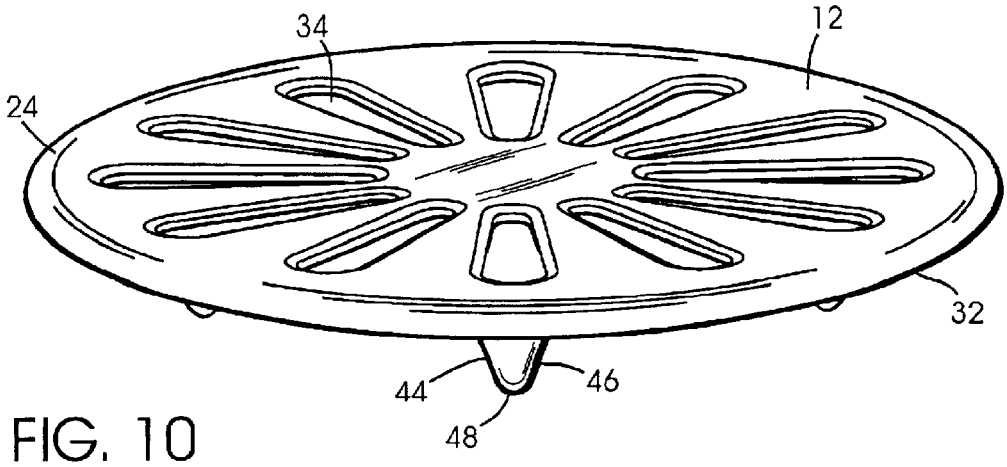
FIG. 10 is a side perspective view of the third embodiment of the present invention illustrating the positioning of a plurality of protuberances extending downwardly from a bottom planar surface.

Referring now to FIG. 1, the floatable barrier 10 further comprises a plurality of apertures 34 collectively located near and along the periphery thereof, near the outer edge, each of which substantially extending from the top planar surface 12 to the bottom planar surface 14. The apertures, as shown in FIGS. 7 through 10, may comprise of various geometric shapes, but would be limited in number to retain the desirable objectives presented herein. Preferably, each aperture comprises a circular configuration to simplify the process of manufacture. As illustrated in FIGS. 7 and 9, the apertures are spaced equally apart from one another in a linear fashion and collectively serve to enhance the passage of substances into the beverage container 16 together with that of the annular opening 30 existing between the outer wall 22 and cylindrical wall 20 of the beverage container. Although the presence of the apertures may have deleterious impact on the available space for displaying adverting material, each aperture 34 is sufficiently small in size so as not to unduly compromise other desirable characteristics of the present invention, namely a floating device having the capacity to act in retarding oxidation, preventing the loss of volatiles, and mitigating the potential for contamination of the beverage container's contents. In some instances, it may be more desirable or appropriate, particularly when the contents are established at a high thermal capacity, to place the floatable barrier into the beverage container prior to the introduction of the comestible liquid to prevent the occurrence of injury to the user, as the placement of the floatable barrier after the introduction of the liquid may splash onto the user. In an alternative embodiment, the top planar surface may further comprise of a handle assembly 36 extending upwardly therefrom and integrally connected thereto to assist in inserting and removing the floatable barrier 10 into and from the beverage container 16, respectively, being most needed if the beverage container is filled with a heated comestible liquid, as shown in FIGS. 7 and 8. Also, the handle may serve to assist in stirring the comestible liquid should the same be introduced after placement of the floatable barrier into the beverage container. In order to promote the desirable condition of laminar flow over the floatable barrier and alleviate any concern of causing unwanted turbulence leading to undue volatilization at the moment of introducing heated liquids into the beverage container 16, specifically after placement of the floatable barrier therein, each aperture 34 comprises an inner wall 38. As shown in FIG. 4, each inner wall is geometrically configured with a pair of beveled edges 40 of equivalent shape and form and a vertical wall 42 situated therebetween. A beveled edge ranging from approximately 450°–600° from the vertical axis, as depicted along path M in FIG. 4, acceptably provides for laminar flow conditions as substances are introduced into and released from the beverage container.

Figure 11:
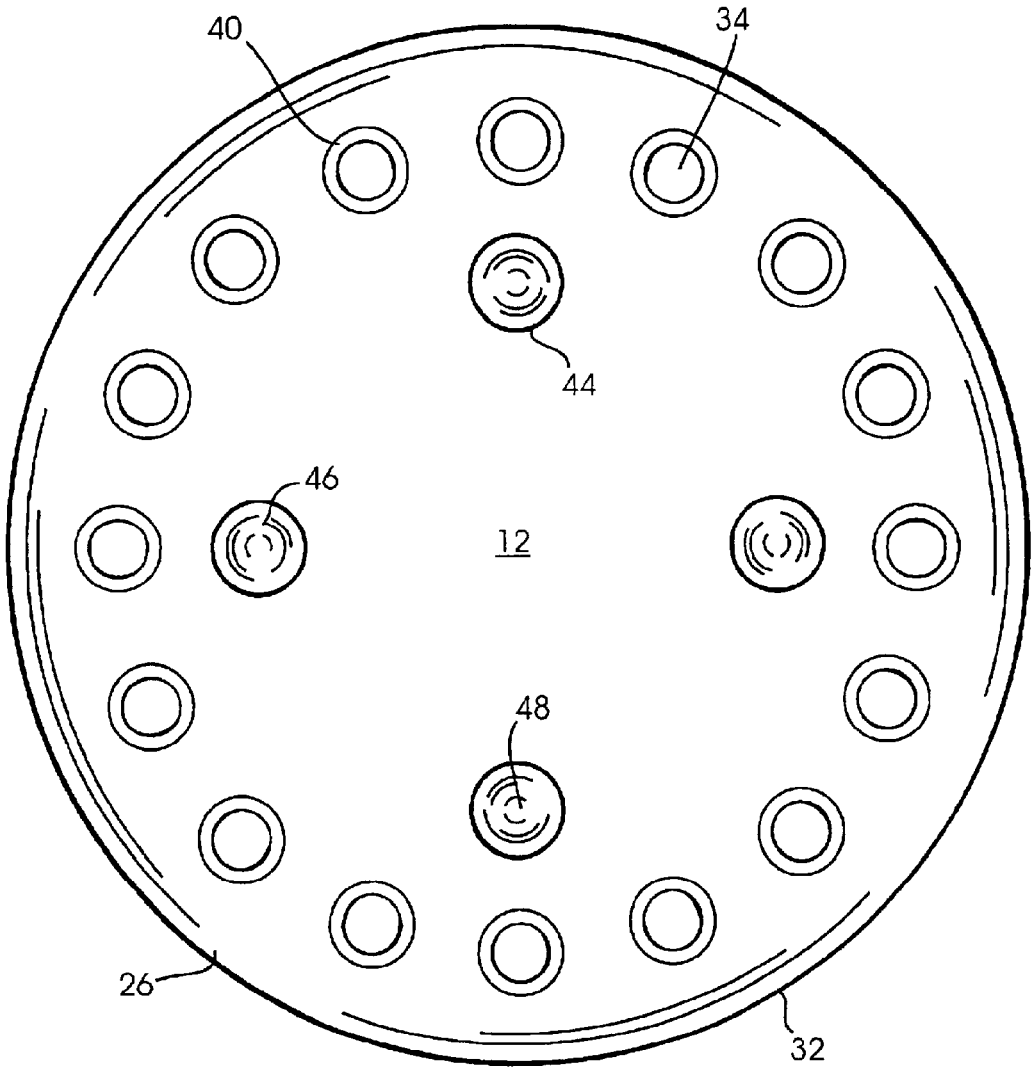
FIG. 11 is a bottom view of the preferred embodiment of the present invention illustrating the positioning of a plurality of protuberances connected to a bottom planar surface.
Figure 12:
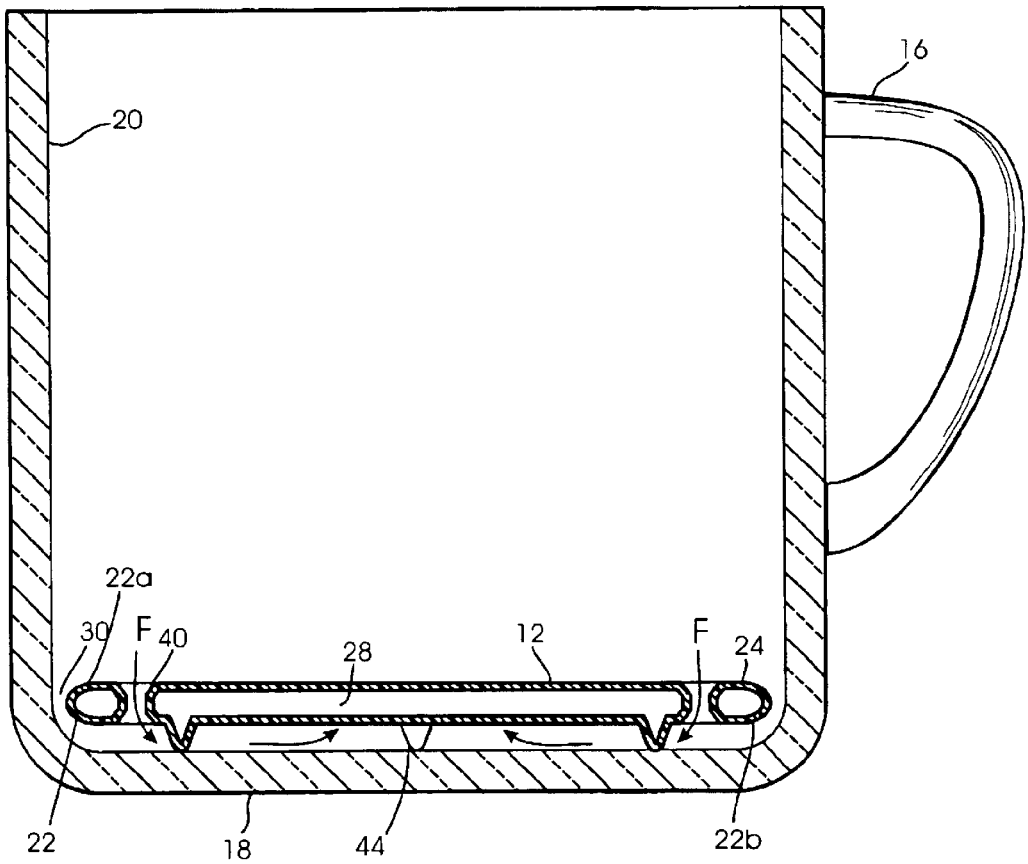
FIG. 12 is a side cross sectional view of the preferred embodiment of the present invention taken on line 5—5 of FIG. 6 illustrating the positioning thereof in a beverage container absent a comestible liquid.

As illustrated in FIG. 11, the bottom planar surface 14 comprises a plurality of protuberances 44 extending downwardly therefrom to principally serve as means for stirring the contents contained in the beverage container 16, since the presence of the floatable barrier 10 in the beverage container can effectively limit the user's ability to mix and stir the contents therewithin should the need arise. Moreover, the protuberances 44 effectively serve as means for allowing liquids, as designated by flow lines F in FIG. 12, to flow under the floatable barrier in direct communication with the bottom surface 14 to assist in raising and initiating the buoyancy action of the floatable barrier, being notably needed when the floatable barrier is placed into the beverage container absent of any liquid content. As shown in FIG. 12, each protuberance comprises a conically-shaped wall 46 converging to a lowermost tip 48 for engaging the circular base 18 of the beverage container 16, being appreciably apparent absent any liquefiable content in the beverage container. Although the presence of the protuberances may deleteriously impact the weight of the floatable barrier, and thus its buoyancy, it is preferred that each protuberance comprise an inner cavity 50 preferably containing therein the same or equivalent material used in the inner chamber 28, namely a gas.

In some instances of its use, the floatable barrier may be temporarily attached to the circular base 18 of the beverage container using a dissolvable, edible substance, such as corn syrup or an equivalent adhering substance, placed at the lowermost tip 48. Release of the floatable barrier from the circular base is simply accomplished by dissolving the adhering substance through the introduction of a heated comestible liquid, such as coffee or tea, into the beverage container. This arrangement is particularly suitable where the beverage container 16 is preferably placed in an inverted orientation to inhibit the introduction or prevent the accumulation of foreign matter into the beverage container prior to the introduction of the comestible liquid. This attachment methodology effectively provides an opportunity to time delay the promotion of an event while retaining the desirable orientation of the beverage container for short-term storage, an arrangement of which can be readily observed at seminars, conventions and other promoting events where beverages are being offered apart from the beverage container.

It can be seen from the foregoing that there is provided in accordance with this invention a simple and easily operated device, which is particularly suitable for use in a beverage container 16 of the type commonly known in the art and utilized in a typical office or home environment. The floatable barrier 10 is completely functional in terms of accommodating the geometric configuration of the beverage container 16 so as to effectively mitigate the release of liquids therefrom during transport and handling thereof as well as retaining the thermal capacity of substances contained therewithin.

It is obvious that the components comprising the floatable barrier may be fabricated from a variety of materials, providing such selection or use of materials possess the capacity of withstanding moderate to high temperatures of liquids that may be introduced into the beverage container. It is most desirable, and therefore preferred, to construct the floatable barrier 10 from a hydrophobic, food-grade polymeric material to ensure sustained reliability during use thereof, as hereinbefore stated.

While there has been shown and described a particular embodiment of the invention, it will be obvious to those skilled in the art that various changes and alterations can be made therein without departing from the invention and, therefore, it is aimed in the appended claims to cover all such changes and alterations as fall within the true spirit and scope of the invention.

What is claimed is:

1. A floatable barrier for use with a beverage container having a circular base and a cylindrical wall substantially extending vertically therefrom, principally serving to contain a comestible liquid, said floatable barrier comprising, in combination:

top and bottom planar surfaces for displaying advertising material thereon and for engaging a substantial portion of the comestible liquid contained in the beverage container, respectively, said top and bottom planar surfaces each being spaced apart from one another a predetermined distance, primarily positioned in a parallel arrangement, and having a peripheral edge in proximity to the cylindrical wall of the beverage container;

an outer wall having uppermost and lowermost ends connected to said peripheral edges of said top and bottom planar surfaces, respectively, to the extent said outer wall is situated in between said top and bottom planar surfaces, said outer wall and top and bottom planar surfaces being integrally molded together to form a one-piece structure having an inner chamber possessing thermal retaining and buoyancy characteristics;

a plurality of apertures each substantially extending from said top planar surface to said bottom planar surface, through said inner chamber, near and along the peripheral edge of said top and bottom planar surfaces, to substantially ensure the continuous passing of the comestible liquid into and from the beverage container; and a plurality of protuberances each being positioned radially inward from said apertures and integrally attached to said bottom planar surface and extending downwardly therefrom to substantially engage and permit stirring of the comestible liquid.

2. A floatable barrier as set forth in claim 1, wherein each of said apertures comprises an inner wall to promote laminar flow conditions and to mitigate the occurrence of turbulence leading to undue volatilization as the comestible liquid is placed into and drawn from the beverage container.

3. A floatable barrier as set forth in claim 2, wherein said inner wall comprises a pair of beveled edges of equivalent shape and form and a vertical wall situated therebetween, said beveled edges being adaptably configured to assist in allowing flow of the comestible liquid to said bottom planar surface insofar to promote buoyancy and raise said top and bottom planar surfaces from the circular base of the beverage container, being notably needed when the beverage container is absent of and later filled with the comestible liquid.

4. A floatable barrier as set forth in claim 3, wherein each of said beveled edges comprises an angular relationship to a vertical axis extending perpendicular to said top and bottom surfaces ranging from 45° to 60°.

5. A floatable barrier as set forth in claim 3, wherein each of said beveled edges comprises an angular relationship to a vertical axis extending perpendicular to said top and bottom planar surfaces of 60°.

6. A floatable barrier as set forth in claim 1, wherein said top and bottom planar surfaces comprise a diameter ranging from 90% to less than 100% of the effective inner diameter of the beverage container insofar to form an annular opening between said outer wall and the cylindrical wall of the beverage container for passage of the comestible liquid.

7. A floatable barrier as set forth in claim 6, wherein said annular opening is approximately ⅛" wide.

8. A floatable barrier as set forth in claim 1, wherein each of said protuberances comprises a conically-shaped wall converging downwardly to a lowermost tip and an inner cavity integrally communicating with said inner chamber.

9. A floatable barrier as set forth in claim 1, wherein said inner chamber is filled with an inert gas to promote continued buoyancy of said top and bottom planar surfaces and outer wall and to retain the thermal capacity of the comestible liquid within the beverage container.

10. A floatable barrier as set forth in claim 1, wherein said top and bottom planar surfaces are fabricated from a translucent polypropylene material and said inner chamber is filled with thermotropic liquid crystals having temperature dependent characteristics insofar to promote time-delayed display of advertising material adaptably affixed to said top planar surface.

11. A floatable barrier as set forth in claim 1, wherein said top and bottom planar surfaces and outer wall are fabricated from a hydrophobic, food-grade polymeric material having heat resisting and thermal retaining characteristics.

12. A floatable barrier as set forth in claim 1, wherein said top planar surface further comprises a handle extending upwardly therefrom and affixed thereto to assist in stirring the comestible liquid within and removing said floatable barrier from the beverage container.

13. A floatable barrier as set forth in claim 1, wherein said inner chamber is filled with an air-entrained, light-weighted solid to promote continued buoyancy of said top and bottom planar surfaces and outer wall and to retain the thermal capacity of the comestible liquid within the beverage container.

14. A floatable barrier as set forth in claim 1, wherein said outer wall further comprises an apex situated midway in between said uppermost and lowermost ends and extending furthermost therefrom a predetermined distance, said apex being substantially capable of corresponding to the level of the comestible liquid in either a static or dynamic state.

15. A floatable barrier as set forth in claim 1, wherein said outer wall comprises a rounded geometric configuration.

16. A method for displaying advertising material and mitigating the inadvertent release of a comestible liquid from a beverage container during the handling and transport thereof, said method comprising the steps of:

connecting top and bottom planar surfaces to uppermost and lowermost ends of an outer wall, respectively, to the extent said outer wall is situated in between said top and bottom planar surfaces to integrally form a one-piece structure having an inner chamber substantially configured to house a gas for continued buoyancy and retain the thermal characteristics of the comestible liquid;

affixing to said top planar surface advertising material made suitable for promoting an event or sale of a good or service;

configuring said top and bottom planar surfaces with a plurality of apertures collectively positioned along the periphery thereof and extending from said top planar surface to said bottom planar surface, through said inner chamber, to permit the passage of comestible liquids to and from the beverage container;

configuring said bottom planar surface with a plurality of protuberances each being positioned radially inward from said apertures and extending downwardly therefrom to substantially engage and permit stirring of the comestible liquid; and placing said top planar surface upright into the beverage container, with said bottom planar surface being downwardly positioned insofar to permit substantial contact with the comestible liquid.

17. A method as set forth in claim 16, wherein each of said protuberances comprises a conically-shaped wall converging downwardly to a lowermost tip and an inner cavity integrally communicating with said inner chamber.

18. A floatable barrier for use with a beverage container having a circular base and a cylindrical wall substantially extending vertically therefrom, principally serving to contain a comestible liquid, said floatable barrier comprising, in combination:

top and bottom planar surfaces for displaying advertising material thereon and for engaging a substantial portion of the comestible liquid contained in the beverage container, respectively, said top and bottom planar surfaces each being spaced apart from one another a predetermined distance, primarily positioned in a parallel arrangement, and having a peripheral edge in proximity to the cylindrical wall of the beverage container;

an outer wall having uppermost and lowermost ends connected to said peripheral edges of top and bottom planar surfaces, respectively, to the extent said outer wall is situated in between said top and bottom planar surfaces, said outer wall and top and bottom planar surfaces being integrally molded together to form a one-piece structure having an inner chamber possessing thermal retaining and buoyancy characteristics;

a plurality of apertures each substantially extending from said top planar surface to said bottom planar surface, through said inner chamber, near and along the peripheral edge of said top and bottom planar surfaces, each of said apertures comprising an inner wall to promote laminar flow conditions and to mitigate the occurrence of turbulence leading to undue volatilization as the comestible liquid is placed into and drawn from the beverage container, said inner wall comprising a pair of beveled edges of equivalent shape and form and a vertical wall situated therebetween, said beveled edges being adaptably configured to allow flow of the comestible liquid to said bottom planar surface insofar to promote buoyancy and raise said top and bottom planar surfaces from the circular base of the beverage container, being notably needed when the beverage container is absent of and later filled with the comestible liquid; and a plurality of protuberances each being positioned radially inward from said apertures and integrally attached to said bottom planar surface and extending downwardly therefrom to substantially engage and permit stirring of the comestible liquid, each of said protuberances comprising a conically-shaped wall converging downwardly to a lowermost tip and an inner cavity integrally communicating with said inner chamber.

19. A floatable barrier as set forth in claim 18, wherein said inner chamber is filled with an inert gas to promote continued buoyancy of said top and bottom planar surfaces and outer wall and to retain the thermal capacity of the comestible liquid within the beverage container.

20. A floatable barrier as set forth in claim 18, wherein each of said beveled edges comprises an angular relationship to a vertical axis extending perpendicular to said top and bottom planar surfaces ranging from 45° to 60°.

21. A floatable barrier as set forth in claim 18, wherein said top planar surface further comprises a handle extending upwardly therefrom and affixed thereto to assist in stirring the comestible liquid within and removing said floatable barrier from the beverage container.

* * * * *